US010351985B2

(12) United States Patent
Ihne et al.

(10) Patent No.: US 10,351,985 B2
(45) Date of Patent: Jul. 16, 2019

(54) METHOD AND APPARATUS FOR RINSING LAUNDRY IN A LAUNDRY TREATING APPLIANCE

(71) Applicant: Whirlpool Corporation, Benton Harbor, MI (US)

(72) Inventors: Sarah Ihne, Stevensville, MI (US); Alvaro Vallejo Noriega, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 410 days.

(21) Appl. No.: 14/337,511

(22) Filed: Jul. 22, 2014

(65) Prior Publication Data

US 2014/0331413 A1 Nov. 13, 2014

Related U.S. Application Data

(62) Division of application No. 13/079,050, filed on Apr. 4, 2011, now abandoned.

(51) Int. Cl.
*D06F 35/00* (2006.01)
*D06F 33/02* (2006.01)

(52) U.S. Cl.
CPC ..... *D06F 33/02* (2013.01); *D06F 35/006* (2013.01); *D06F 2204/065* (2013.01); *D06F 2204/08* (2013.01)

(58) Field of Classification Search
CPC .. D06F 39/028; D06F 2204/08; D06F 35/005; D06F 35/006; D06F 39/022; D06F 39/088
USPC ..... 68/17 R
See application file for complete search history.

(56) References Cited

U.S. PATENT DOCUMENTS 2,489,278 A * 11/1949 Fink ..... D06F 49/006 210/210
4,489,455 A * 12/1984 Spendel ..... C11D 11/0017 510/306
5,335,524 A * 8/1994 Sakane ..... D06F 35/006 68/12.02
6,269,666 B1 * 8/2001 Whah ..... D06F 39/06 68/12.02
2005/0000031 A1 * 1/2005 Price ..... C11D 3/0015 8/142
2006/0248658 A1 * 11/2006 Ha ..... D06F 35/006 8/147

(Continued)

FOREIGN PATENT DOCUMENTS

DE 3811583 A1 * 10/1989 ..... D06F 37/28

OTHER PUBLICATIONS

DE3811583—Machine Translation (Year: 1989).*

*Primary Examiner* — Marc Lorenzi
(74) *Attorney, Agent, or Firm* — Price Heneveld LLP

(57) ABSTRACT

A cycle of operation for a laundry treating appliance having a rotatable treating chamber for receiving a laundry load including a washing phase having an application of a treating chemistry to the laundry load to separate soils from the laundry load, an extracting phase having a centrifugal extraction of at least some of the treating chemistry from the laundry load, and a rinsing phase having a spraying of an amount of rinse water onto the laundry load to evenly wet the laundry load to form a wetted laundry load and an applying of a bleach solution to the wetted laundry load.

15 Claims, 3 Drawing Sheets

(56) References Cited

U.S. PATENT DOCUMENTS

| | | | | |
|---|---|---|---|---|
| 2008/0053161 | A1* | 3/2008 | Dahlke | D06F 37/266 68/13 R |
| 2008/0276962 | A1* | 11/2008 | Wright | D06F 35/003 134/10 |
| 2008/0307667 | A1* | 12/2008 | Ikemizu | D06F 35/008 34/132 |
| 2009/0050178 | A1* | 2/2009 | Cho | D06F 35/005 134/18 |
| 2010/0322819 | A1* | 12/2010 | Kim | D06F 25/00 422/5 |
| 2011/0099727 | A1* | 5/2011 | Kim | D06F 35/006 8/137 |
| 2011/0185515 | A1* | 8/2011 | Sans Rovira | D06F 35/006 8/137 |

* cited by examiner

METHOD AND APPARATUS FOR RINSING LAUNDRY IN A LAUNDRY TREATING APPLIANCE

RELATED APPLICATION

This application is a divisional of U.S. patent application Ser. No. 13/079,050, entitled "Method and Apparatus for Rinsing Laundry in a Laundry Treating Appliance," and filed on Apr. 4, 2011, the entirety of which is incorporated herein by reference.

BACKGROUND

Laundry treating appliances, such as a clothes washer, in which a drum defines a treating chamber for receiving a laundry load, may implement a cycle of operation. The cycle of operation may include different phases during which liquid is applied to the laundry load. One such phase is a rinsing phase, in which liquid and/or a treating chemistry is applied to the already-washed laundry load. For example, treating chemistries like bleach are often applied during a rinsing phase. The use of bleach is not desired for all laundry loads, and, therefore, cannot be dispensed by an automatic system. A user typically controls the dispensing of bleach by deciding whether to manually fill a bleach dispenser before each cycle of operation.

SUMMARY

The invention relates to a laundry treating appliance and method for rinsing a laundry load, including spraying the laundry load with water to form a wetted laundry load, and applying a bleach solution to the wetted laundry load.

DETAILED DESCRIPTION

Figure 1:
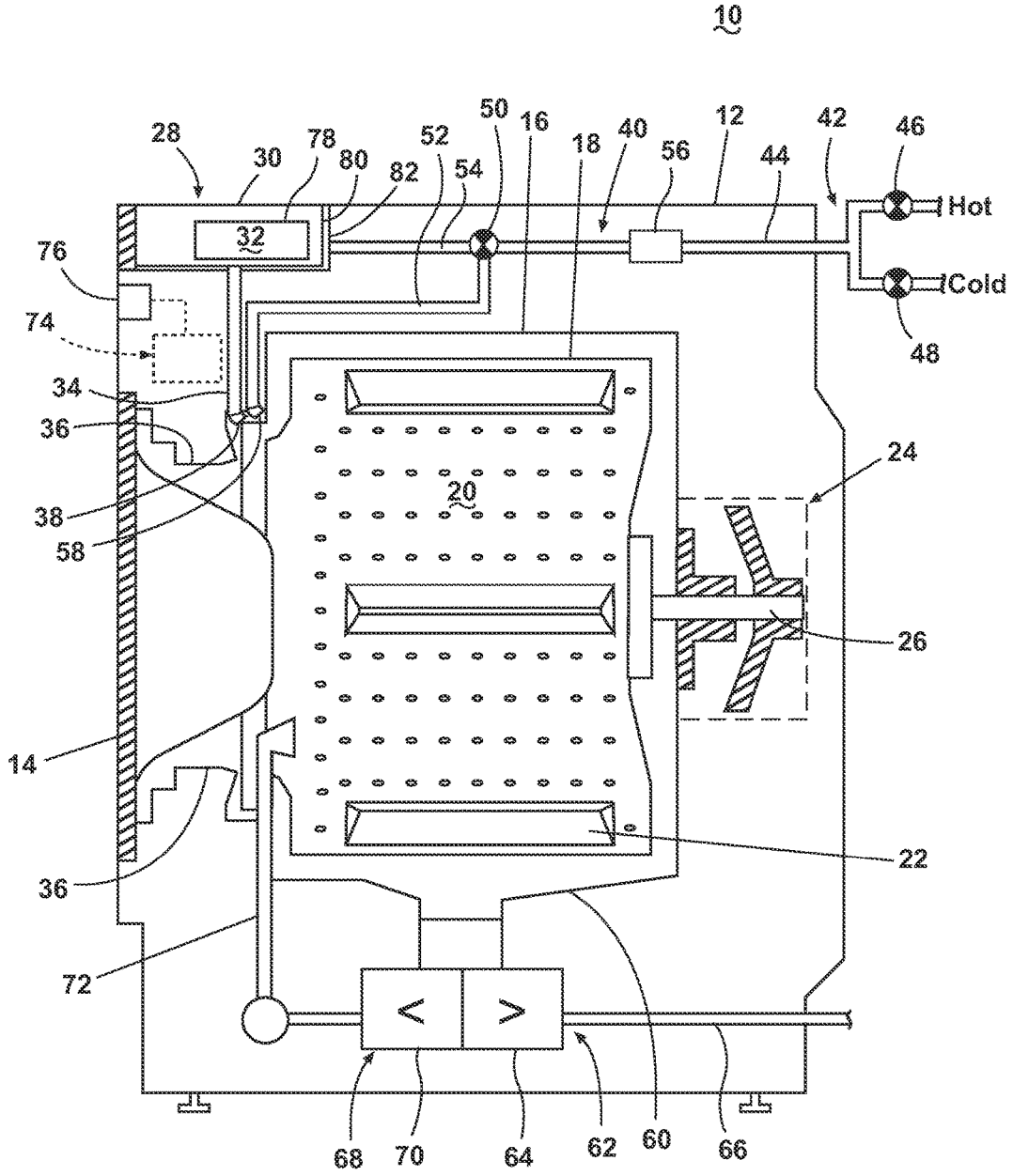
FIG. 1 is a schematic view of a laundry treating appliance in the form of a clothes washer according to an embodiment of the invention.

FIG. 1 is a schematic view of a laundry treating appliance in the form of a clothes washer 10 according to an embodiment of the invention. While the laundry treating appliance is illustrated as a horizontal axis clothes washer 10, the laundry treating appliance according to the invention may be any appliance which performs a cycle of operation on laundry, non-limiting examples of which include a vertical axis clothes washer; a combination washing machine and dryer; a tumbling or stationary refreshing/revitalizing machine; an extractor; a non-aqueous washing apparatus; and a revitalizing machine. The clothes washer 10 described herein shares many features of a traditional automatic clothes washer, which will not be described in detail except as necessary for a complete understanding of the invention. Although much of the remainder of this application will focus on the embodiment of an automatic clothes washer 10, the invention may have utility in other environments, including other cleaning appliances, especially in dishwashers.

The clothes washer 10 may include a cabinet 12, which may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

A door 14 may be mounted to the cabinet 12 to selectively close an access opening to the interior of liquid-holding, imperforate tub 16. The tub 16 may be supported within the cabinet 12 by a suitable suspension system (not shown). A drum 18 may be provided within the tub 16 and may have an inner periphery at least partially defining a treating chamber 20 for receiving fabric, such as laundry to be treated according to a cycle of operation. The drum 18 may be mounted for rotation within the tub 16 and may have perforations that permit the flow of liquid between the drum 18 and the tub 16.

The tub 16 and drum 18 may have aligned openings, which provide access to the treating chamber 20. The door 14 may be provided to selectively close at least one of the aligned openings to selectively provide access to the treating chamber 20. While the illustrated washing machine 10 includes both the tub 16 and the drum 18, with the drum 18 defining the treating chamber 20, it is within the scope of the invention for the clothes washer 10 to include only one receptacle, with the receptacle defining the treating chamber 20 for receiving the laundry load to be treated.

At least one lifter 22 may be provided in the drum 18 to facilitate movement of the laundry load within the drum 18 as the drum 18 rotates. The lifter 22 may be provided on the inner periphery of the drum 18. Multiple lifters 22 can be provided and can be evenly spaced about the inner periphery of the drum 18.

The drum 18 may be coupled with a motor 24 through a drive shaft 26 for selective rotation of the treating chamber 20 during a cycle of operation. It may also be within the scope of the invention for the motor 24 to be coupled with the drive shaft 26 through a drive belt for selective rotation of the treating chamber 20. The motor 24 may rotate the drum 18 at multiple or variable speeds and in opposite rotational directions.

A dispensing system 28 illustrated as a treating chemistry dispenser 30 may be provided within the cabinet 12 and may include at least one treating chemistry reservoir 32. One or more treating chemistries may be provided in the treating chemistry reservoir in any desirable configuration, such as a single charge, multiple charges (also known as bulk supply), or both. Examples of typical treating chemistries include, without limitation, bleach, water, detergent, fabric softener, and enzymes.

An outlet conduit 34 may fluidly couple the dispenser 30 with the tub 16. The outlet conduit 34 may couple with the tub 16 at any suitable location on the tub 16. The liquid that flows from the dispenser 30 through the outlet conduit 34 to the tub 16 may enter a space between the tub 16 and the drum 18. A shown, the outlet conduit 34 is coupled with a bellows 36 that couples an open face of the tub 16 with the cabinet 12 (the door 14 seals against the bellows 36 when the door 14 closes the tub 16 and drum 18). The outlet conduit 34 may comprise a dispensing nozzle 38 configured to dispense treating chemistry into the tub 16 in a desired pattern and under a predetermined amount of pressure. For example, the dispensing nozzle 38 may be configured to dispense a stream of treating chemistry into the tub 16 by gravity, i.e. a non-pressurized stream. The dispensing nozzle 38 may be mounted to the bellows 36.

The at least one treating chemistry reservoir 32 may include a dispensing cup 78 that stores a single dose of treating chemistry, i.e., typically the entire volume of chemistry contained within the dispensing cup 78 is dispensed into the drum 16 during a single cycle of operation. The dispensing cup 78 may be provided on an exterior or interior of the cabinet 12 and may be immediately accessible by the user or hidden behind a cover, such as drawer or access panel. While not illustrated herein, the dispensing system 28 may include multiple dispensing cups for different types of treating chemistry. Further, the dispensing system 28 may include a bulk dispensing subsystem, such that multiple doses of a treating chemistry can be stored within the dispensing system and dispensed over multiple cycles of operation.

The dispensing cup 78 may be carried by a dispensing drawer 80 slidably received within the cabinet 12 or within a separate dispenser housing 82, as shown herein, which may be provided in the cabinet 12. The dispensing drawer 80 is moveable between a fill position, where the dispensing cup 78 is exterior to the cabinet 12 and may be filled with treating chemistry, and a dispense position, where the dispensing cup 78 is interior of the cabinet 12 and fluidly coupled to the outlet conduit 34. The dispensing system 28 may be configured such that when the dispensing cup 78 overflows with liquid, the overflow passes to dispensing drawer 80 and housing 82, and then to the outlet conduit 34.

Figure 2:
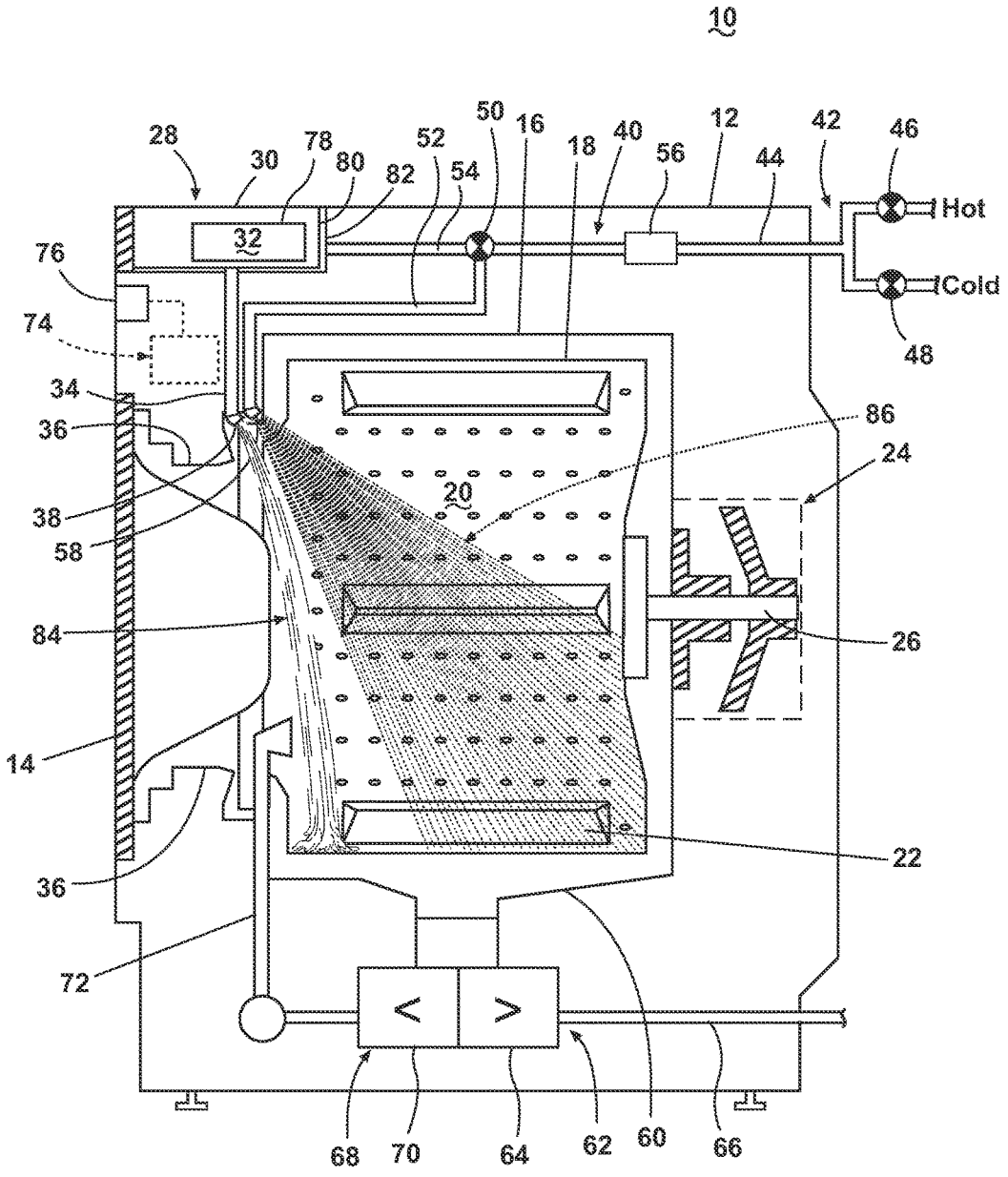
FIG. 2 is a schematic view similar to FIG. 1, illustrating a comparison of a coverage pattern of a spray nozzle and a dispensing nozzle of the clothes washer from FIG. 1.

Although the dispensing system 28 of FIG. 2 includes a dispenser drawer 80 and housing 82, the dispenser drawer 80 and housing 82 could be eliminated and replaced with a conduit. In that case, the overflow from the dispensing cup 78 may pass more or less directly to the outlet conduit 34.

In one implementation of the invention, the treating chemistry stored in the dispensing cup 78 can comprise bleach; as such, the treating chemistry dispenser 30 can more specifically be referred to as a bleach dispenser. The dispensing cup 78 can receive a single charge or dose of bleach for use during a single cycle of operation. Although much of the remainder of this application will focus on the embodiment of the bleach dispenser 30, the invention may have utility with in other types of treating chemistries.

A liquid supply system 40 may also be included in the clothes washer 10 to supply liquid to both the treating chemistry dispenser and/or the tub 16. More specifically, liquid such as water may be supplied from a water source 42, such as a household water supply, to the clothes 10 by operation of at least one control valve controlling the flow of water through an inlet conduit 44. As shown herein, separate valves 46, 48 controlling hot and cold water, respectively, through the inlet conduit 44 may be provided. A diverter mechanism 50, such as a diverter valve, may fluidly couple with the inlet conduit 44 and may have two outlets such that the diverter mechanism 50 may selectively direct a flow of liquid through a first supply conduit 52 leading to the tub 16 or through a second supply conduit 54 leading to the dispenser 30. A flow meter 56 may be positioned in the inlet conduit 44 and may have any suitable output representative of the flow of water through it.

The first supply conduit 52 may fluidly couple the inlet conduit with the tub 16. The first supply conduit may couple with the tub 16 at any suitable location on the tub 16. The liquid that flows through the first supply conduit 52 to the tub 16 may enter a space between the tub 16 and the drum 18. As shown, the first supply conduit 52 is coupled with the bellows 36. The first supply conduit 52 may comprise a spray nozzle 58 configured to dispense liquid into the tub 16 in a desired pattern. For example, the spray nozzle 58 may be configured to spray a pressurized flow of liquid into the tub 16. The spray nozzle 58 may be mounted to the bellows 36.

The path of liquid through the first supply conduit 52 may define at least a portion of a first flow path through the clothes washer 10. Specifically, the first flow path may extend from the diverter mechanism 50, through the first supply conduit 52, and into the tub 16 via the spray nozzle 58.

The path of liquid through the second supply conduit 54 may define at least a portion of a second flow path through the clothes washer 10. Specifically, the second flow path may extend from the diverter mechanism 50, through the second supply conduit 54, and though the reservoir 32, such that water flowing through the second flow path can flush treating chemistry out of the reservoir and into the outlet conduit 34. The mixture of water and treating chemistry can then flow into the tub 16 via the dispensing nozzle 38.

The first and second flow paths can be completely separate. Alternatively, at least a portion of both the first and second flow paths may extend through the treating chemistry dispenser 30 as well. However, in this case, the first flow path does not extend through the reservoir 32, such that treating chemistry stored within the reservoir 32 is not taken up by water flowing along the first flow path.

Liquid in the treating chamber 20 may flow by gravity to a low portion or sump 60 of the tub 16. A liquid drain system 62 may be provided for draining liquid from the treating chamber 20. The liquid drain system 62 may include a drain pump 64 and a drain conduit 66. The drain pump 64 fluidly couples the sump 60 to the drain conduit 66 such that liquid in the tub 16 may be drained via the drain conduit 66. The drain conduit 66 may be coupled with a household drain.

A liquid recirculation system 68 may be provided for recirculating liquid to the treating chamber 20. As illustrated, the recirculation system 68 includes a recirculation pump 70 and a spray conduit 72. The recirculation pump 70 may fluidly couple the tub 16 to the spray conduit 72 such that liquid in the tub 16 may be supplied to the spray conduit 72, where it may be sprayed into the treating chamber 20. The recirculation pump 70 may be fluidly coupled to the sump 60 of the tub 16. The spray conduit 72 may direct the liquid from the recirculation pump 70 into the drum 18 in any suitable manner, such as by spraying, dripping, or providing a steady flow of the liquid. While the clothes washer 10 is illustrated as having separate drain and recirculation pumps 64, 70 in an alternative embodiment, the clothes washer 10 may include a single pump configured to selectively drain or recirculate liquid, such as by configuring the pump to rotate in opposite directions, or by providing a suitable valve system.

The clothes washer 10 may further include one or more devices for heating the liquid such as a steam generator and/or a sump heater (not shown). The steam generator may be provided to supply steam to the treating chamber 20. The sump heater may be used to heat liquid in the sump 60. Alternatively, the sump heater may be used to heat laundry (not shown), air, the drum 18, or liquid in the tub 16 to generate steam, in place of or in addition to the steam generator. The steam generator may be used to heat to the laundry as part of a cycle of operation, much in the same manner as sump heater, as well as to introduce steam to treat the laundry.

A controller 74 may be located within the cabinet 12 for controlling the operation of the clothes washer to implement one or more cycles of operation, which may be stored in a memory of the controller 74. Examples, without limitation, of cycles of operation include: wash, heavy duty wash, delicate wash, quick wash, refresh, rinse only, and timed wash. A user interface 76 that is operably coupled to the controller 74 may also be included on the cabinet 12 and may include one or more knobs, switches, displays, and the like for communicating with the user, such as to receive input and provide output. The user may enter many different types of information, including, without limitation, cycle selection and cycle parameters, such as cycle options.

During operation of the clothes washer 10, the controller 74 may be operably coupled with one or more components of the clothes washer 10 for communicating with and controlling the operation of the component to complete a cycle of operation. For example, the controller 74 may be operably coupled with at least the motor 24, the valves 46, 48, diverter mechanism 50, the flow meter 56, the drain pump 64, and the recirculation pump 70 to control the operation of these and other components to implement one or more of the cycles of operation.

FIG. 2 is a schematic view similar to FIG. 1, illustrating a comparison of a coverage pattern of the dispensing nozzle 38 and the spray nozzle 58. The dispensing nozzle 38 and the spray nozzle 58 can be configured to have different patterns of coverage. For example, the dispensing nozzle 38 can be configured to emit a flow or stream of bleach solution in a first predetermined coverage pattern 84 that covers less than 5% of the lower half of the treating chamber 20. In contrast, the spray nozzle 58 can be configured to emit droplets of water in a second predetermined coverage pattern 86 that covers at least 50% of the lower half of the treating chamber 20. The second predetermined coverage pattern 86 may having a cone-like shape extending from the spray nozzle 58, while the first predetermined coverage pattern 84 may have a narrower column-like shape extending from the dispensing nozzle 38.

The previously described clothes washer 10 provides the structure necessary for the implementation of a method of the invention. One embodiment of the method of the invention will now be described in terms of the operation of the clothes washer 10.

Figure 3:
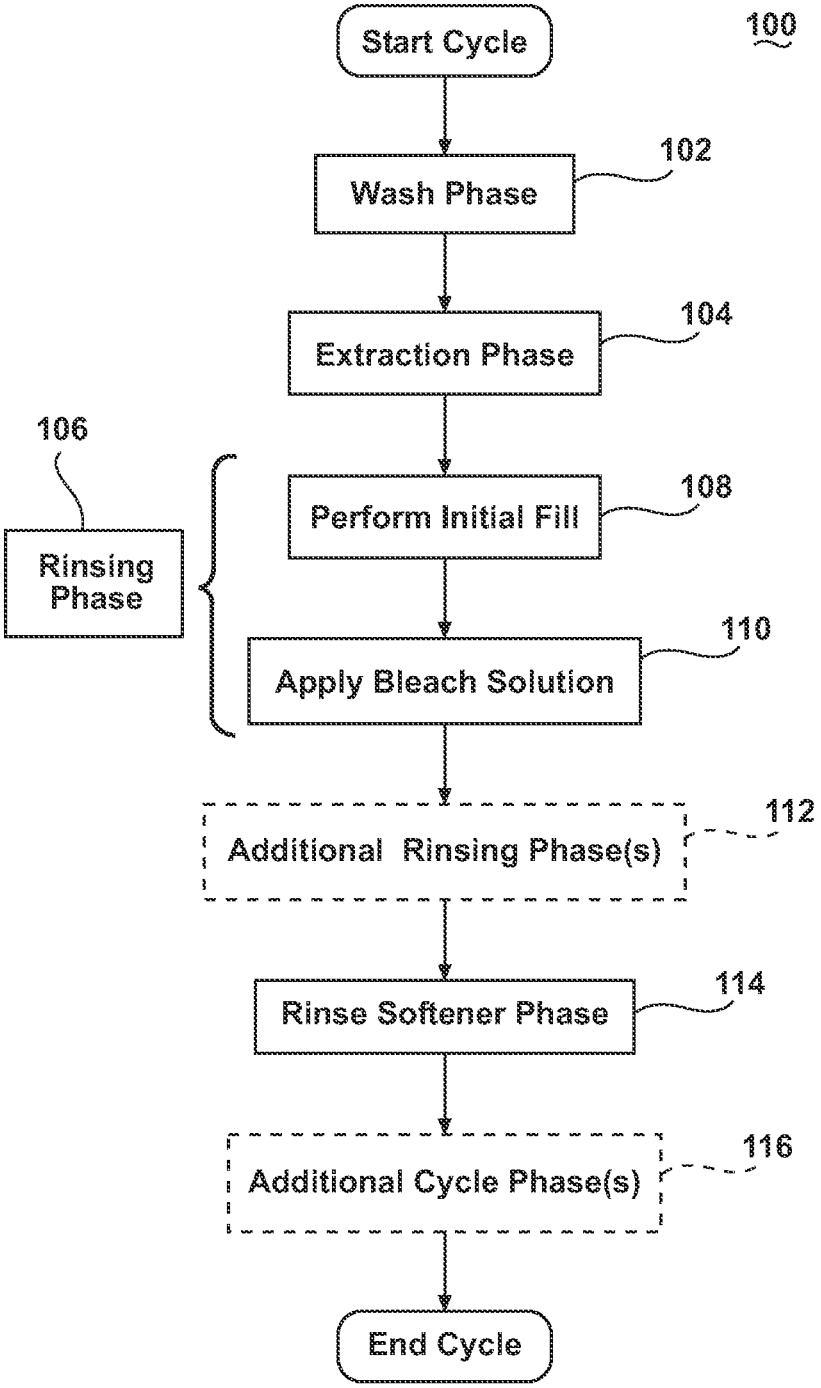
FIG. 3 is flowchart illustrating a method of operating the clothes washer from FIG. 1, including rinsing a load laundry with a bleach solution formed in the clothes washer.

FIG. 3 is flowchart illustrating a method 100 of operating a clothes washer, described in reference to the clothes washer 10 of FIGS. 1-2. Specifically, the method 100 rinses a load laundry with a bleach solution formed "on-board" the clothes washer 10. The method 100 can be carried out as a cycle of operation of the clothes washer 10. The method 100 may begin under the assumption that a user has placed a load of laundry into the treating chamber 20, and that a dose of bleach is present in the bleach dispenser 30.

The method 100 can first begin with a washing phase 102, in which treating chemistry is applied to the laundry load to separate soils from the laundry load. This may entail at least partially filling the tub 16 with liquid via the liquid supply system, activating the motor 24 to rotate the drum 18, and/or operating the recirculation pump 70 to direct the liquid in the tub 16 to the spray conduit 72.

Next, an extraction phase 104 commences, in which at least some of the treating chemistry and/or liquid applied in the washing phase 104 is centrifugally extracted from the laundry load. This may entail activating the motor 24 to rotate the drum 18, and/or operating the drain pump 64 to direct the liquid in the tub 16 to the drain conduit 66.

Next, a rinsing phase 106 commences, in which additional liquid is applied to the laundry load to rinse the laundry load. Additionally, treating chemistry in the form of a bleach solution can be applied to the laundry load during the rinsing phase 106 to treat the laundry.

The rinsing phase 106 may begin with an initial fill step 108, which may entail spraying liquid onto the laundry load to evenly wet the load. This liquid can comprise water with or without a treating chemistry. The amount of liquid spray can be an amount that will just wet the load, an amount that will saturate the load, or an amount greater than the amount required to saturate the load.

To spray water alone, the first flow path can be activated by opening at least one of the valves 46, 48 and by positioning the diverter mechanism 50 in communication with the first supply conduit 54. Since the first flow path includes the spray nozzle 58, water can be sprayed into the treating chamber 20 under pressure.

During the initial fill at step 108, the treating chamber 20 can be rotated to tumble the laundry load to distribute the sprayed water throughout the laundry load. The treating chamber 20 can be rotated by activating the motor 24, which turns the drum 18 defining the treating chamber 20. The treating chamber 20 can be continuously rotated, or can be intermittently rotated. For an intermittent rotation, the treating chamber 20 can be rotated in a rotation pattern defined by multiple rotation phases in which the motor 24 is active, separated by non-rotational phases in which the motor 24 is inactive. Likewise, water can be continuously sprayed while the treating chamber 20 is rotated, or can be intermittently sprayed. In one example, where both the rotation of the treating chamber 20 and the spraying of water occur intermittently, water may be sprayed only during the non-rotational phases.

Next, a bleach solution is applied to the wetted laundry load at step 110. The bleach solution may comprise a solution of water and bleach. The clothes washer 10 described above provides the structure necessary for the bleach solution to be formed within the clothes washer 10.

The bleach solution can be formed by activating the second flow path by opening at least one of the valves 46, 48 and by positioning the diverter mechanism 50 in communication with the second supply conduit 54. This permits water to mix with bleach stored in the bleach dispenser 30, resulting in the formation of a bleach solution. Specifically, water entering the bleach dispenser 30 flushes bleach in the dispensing cup 78 into the treating chamber 20 via the outlet conduit 34. Since the second flow path includes the dispensing nozzle 38, the bleach solution can flow into the treating chamber 20 by gravity.

During the application of the bleach solution at step 110, the treating chamber 20 can be rotated to tumble the laundry load to distribute the bleach solution throughout the laundry load. The treating chamber 20 can be rotated by activating the motor 24, which turns the drum 18 defining the treating chamber 20. The treating chamber 20 can be continuously rotated, or can be intermittently rotated. For an intermittent rotation, the treating chamber 20 can be rotated in a rotation pattern defined by multiple rotation phases in which the motor 24 is active, separated by non-rotational phases in which the motor 24 is inactive. The rotation pattern during bleach application may be different than the rotation pattern during water spraying to wet the load, or may be the same. The bleach solution can be continuously applied while the treating chamber 20 is rotated, or can be intermittently applied.

A predetermined amount of water can be sprayed onto the laundry load during steps 108 and 110. The predetermined amount can be based on a total rinse volume of the rinse phase 106, wherein the total rinse volume is approximately equal to the total amount of liquid be applied during the rinse phase 106. Since the rinse phase 106 of the method 100 includes an initial fill of water at step 108 and the application of a bleach solution at step 110, the total rinse volume is approximately equal the combined volume of water and the bleach solution. For example, the predetermined amount of water sprayed at step 108 can be 50% to 95% of the total rinse volume. In order words, if 50% to 95% of the total rinse volume is water sprayed during step 108, then the bleach solution makes up 50% to 5% of the liquid applied during the rinse phase 106 applied at step 110. More specifically, the predetermined amount of water sprayed at step 108 can be approximately 75-95% of the total rinse volume, leaving 25% to 5% of the total rinse volume to be applied as the bleach solution at step 110. Even more specifically, the predetermined amount of water sprayed at step 108 can be approximately 90% of the total rinse volume, leaving approximately 10% of the total rinse volume to be applied as the bleach solution at step 110. While only one fill step 108 is shown, the method 100 may include multiple separate fill steps. In this case, the total rinse volume is approximately equal to the sum total of liquid applied during the multiple fill steps and the bleach application step 110. The sum total volume of water sprayed during the multiple fill steps may be equal to the percentages disclosed above for the single fill step 108.

Optionally, one or more additional rinsing phase(s) 112 can commence after the rinsing phase 106 is complete. During the optional rinsing phase(s) 112, additional liquid is applied to the laundry load to rinse the laundry load. The liquid may include water, bleach, and/or any other treating chemistry. Some non-limiting examples of treating chemistries that are commonly applied when rinsing a laundry load include fabric softeners and conditioners, fabric brighteners, anti-wrinkle agents, anti-microbial agents, and perfumes. While not shown in FIG. 3, one or more additional rinsing phase(s) can occur after the extraction phase 104 but before the rinsing phase 106.

Next, a rinse softener phase 114 commences in which fabric softener is applied to the laundry load. This may entail at least partially filling the tub 16 with liquid via the liquid supply system, and/or activating the motor 24 to rotate the drum 18. The fabric softener may be stored within the dispenser 30, or elsewhere in the clothes washer 10.

Finally, the method 100 may include one or more cycle phases 116 before completing the cycle of operation, such as additional extraction phases in which at least some of the treating chemistry and/or liquid applied in the previous phases is centrifugally extracted from the laundry load.

The clothes washer 10 and method 100 of the invention provide separate flow paths for the application of water and application of bleach to the laundry load. When using a flow path having a pressurized spray, such as from the spray nozzle 58, to wet the laundry load and fill the tub 16 during the rinsing phase 106, the application of bleach solution cannot be accomplished via the same flow path since spraying a bleach solution does not permit the user to decide whether or not to use bleach during a given cycle of operation. As illustrated, clothes washer 10 and method 100 of the invention utilizes a first flow path for applying water to the laundry load, where the first flow path includes the spray nozzle 58 for spraying water on the laundry load, and a second flow path for applying bleach of the laundry load, where the second flow path includes the dispensing nozzle 38 for dispensing a bleach solution on to the laundry load after it has been wetted. Applying water in a spray ensures that all areas of the laundry load are sufficiently wetted before applying the bleach solution. Dispensing the bleach via the dispenser 30 allows the user to selectively fill the reservoir 32 with bleach, thereby, determining if bleach is used as an additive in a given cycle of operation. Furthermore, the clothes washer 10 and method 100 of the invention can be utilized for the application of treating chemistries other than bleach, and can provide separate flow paths for the application of water and application of the treating chemistry to the laundry load.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims. For example, the sequence of steps depicted in each method described herein is for illustrative purposes only, and is not meant to limit the disclosed methods in any way as it is understood that the steps may proceed in a different logical order or additional or intervening steps may be included without detracting from the invention.

What is claimed is:

1. A laundry treating appliance, the laundry treating appliance comprising:

a controller programmed to execute an automatic cycle of operation;

a drum defining a rotatable treating chamber for receiving a laundry load, the rotatable treating chamber positioned in a tub;

a rinse water supply line terminating at a rinse water inlet nozzle to spray rinse water onto the laundry load without passing through a bleach dispenser;

the bleach dispenser fluidly connected through a dispenser outlet line, the dispenser outlet line terminating at a bleach nozzle to spray a bleach solution onto the laundry load, wherein the bleach nozzle is mounted to an end of a bellows, and wherein the rinse water and the bleach solution are delivered in a space between the tub and the drum by the rinse water inlet nozzle and the bleach nozzle, respectively, wherein the dispenser outlet line, the rinse water supply line, the bleach nozzle, and the rinse water inlet nozzle do not penetrate the tub;

a diverter valve having a first position which selectively connects an incoming water supply line to the rinse water supply line while blocking incoming water supply to the bleach dispenser, and the diverter valve having a second position which selectively connects the incoming water supply line to the bleach dispenser while blocking the supply of incoming water to the rinse water supply line;

the rinse water inlet nozzle having a first spray coverage pattern;

the bleach nozzle having a second spray coverage pattern; and the first spray coverage pattern and the second spray coverage pattern are different spray coverage patterns;

the cycle of operation comprising:

a washing phase comprising an application of a treating chemistry to the laundry load to separate soils from the laundry load;

an extracting phase comprising a centrifugal extraction of at least some of the treating chemistry from the laundry load; and a rinsing phase comprising:

positioning the diverter valve in the first position;

a spraying of an amount of rinse water from the rinse water supply line, bypassing the bleach dispenser, and passing through the rinse water inlet nozzle onto the laundry load with the first spray coverage pattern to form a wetted laundry load while the treating chamber is rotated;

positioning the diverter valve in the second position; and an applying of the bleach solution from the bleach dispenser through the dispenser outlet line and passing through the bleach nozzle, without the dispenser outlet line and the bleach nozzle penetrating the tub, with the second spray coverage pattern being applied to the wetted laundry load while the treating chamber is rotated, and wherein the applying of the bleach solution comprises emitting a downwardly-directed stream of bleach solution in a pattern that covers less than 5% of the lower half of the treating chamber, as measured when the treating chamber is in an empty state.

2. The laundry treating appliance of claim 1, wherein the spraying comprises spraying water without the addition of any treating chemistry.

3. The laundry treating appliance of claim 1, wherein the cycle of operation comprises rotating the treating chamber to tumble the laundry load during the spraying to distribute the water on the laundry load.

4. The laundry treating appliance of claim 3, wherein the rotating of the treating chamber comprises intermittently rotating the treating chamber in a rotation pattern defined by multiple rotation phases separated by non-rotational phases.

5. The laundry treating appliance of claim 4, wherein the spraying comprising spraying during the non-rotational phases.

6. The laundry treating appliance of claim 4, wherein the rotating the treating chamber further comprises rotating the treating chamber during the applying, and the rotation pattern of the treating chamber is different during the spraying as compared to the rotation during the applying.

7. The laundry treating appliance of claim 1, wherein the spraying comprises spraying water into the treating chamber under pressure.

8. The laundry treating appliance of claim 1, wherein the applying comprises mixing water and bleach to form the bleach solution.

9. The laundry treating appliance of claim 8, wherein the applying comprises flushing bleach from a bleach container with water.

10. The laundry treating appliance of claim 1, wherein the applying comprises supply the bleach solution into the treating chamber by gravity.

11. The laundry treating appliance of claim 1, wherein the cycle of operation further comprises rotating the treating chamber to tumble the laundry load during the applying to distribute the bleach solution on the laundry load.

12. The laundry treating appliance of claim 1, wherein the amount of water is 50% to 95% of a total rinse volume, wherein the total rinse volume is the combined volume of the amount of water and the bleach solution.

13. The laundry treating appliance of claim 12, wherein the amount of water is 90% of the total rinse volume.

14. The laundry treating appliance of claim 1, wherein the spraying comprises emitting droplets of water in a pattern that covers at least 50% of a lower half of the treating chamber.

15. A laundry treating appliance, comprising:

a controller programmed to execute an automatic cycle of operation;

a drum defining a rotatable treating chamber for receiving a laundry load, the rotatable treating chamber positioned in a tub;

a rinse water supply line terminating at a rinse water inlet nozzle to spray rinse water onto the laundry load without passing through a bleach dispenser;

the bleach dispenser fluidly connected through a dispenser outlet line, the dispenser outlet line terminating at a bleach nozzle to spray a bleach solution onto the laundry load, wherein the bleach nozzle is mounted to an end of a bellows, and wherein the rinse water and the bleach solution are delivered in a space between the tub and the drum by the rinse water inlet nozzle and the bleach nozzle, respectively, wherein the dispenser outlet line, the rinse water supply line, the bleach nozzle, and the rinse water inlet nozzle do not penetrate the tub;

a diverter valve having a first position that selectively connects an incoming water supply line to the rinse water supply line while blocking water from the incoming water supply line from flowing to the bleach dispenser, the diverter valve having a second position that selectively connects the incoming water supply line to the bleach dispenser while blocking water from the incoming water supply line from flowing to the rinse water supply line;

the rinse water inlet nozzle having a first spray coverage pattern;

the bleach nozzle having a second spray coverage pattern;

the first spray coverage pattern and the second spray coverage pattern are different coverage patterns, wherein the second spray coverage pattern of the bleach nozzle comprises emitting a downwardly-directed stream of bleach solution in a pattern that covers less than 5% of the lower half of the treating chamber, as measured when the treating chamber is in an empty-state.

* * * * *